US006163304A

United States Patent [19]

Peebles et al.

[11] Patent Number: 6,163,304

[45] Date of Patent: Dec. 19, 2000

[54] MULTIMODE, MULTI-STEP ANTENNA FEED HORN

[75] Inventors: Ann L. Peebles, Santa Monica; Charles W. Chandler, San Gabriel; George H. Simkins, Torrance, all of Calif.

[73] Assignee: TRW Inc., Redondo Beach, Calif.

[21] Appl. No.: 09/270,952

[22] Filed: Mar. 16, 1999

[51] Int. Cl.[7] ..... H01Q 19/00

[52] U.S. Cl. ..... 343/786; 343/756

[58] Field of Search ..... 343/786, 772, 343/776, 756, 725, 781

[56] References Cited

U.S. PATENT DOCUMENTS

| | | | |
|---|---|---|---|
| 3,568,204 | 3/1971 | Blaisdell | 343/725 |
| 4,122,446 | 10/1978 | Hansen | 343/786 |
| 4,972,199 | 11/1990 | Raghavan | 343/756 |

OTHER PUBLICATIONS

Thomas A. Milligan, "Modern Antenna Design," McGraw–Hill Book Company, pp. 200–205.

P. D. Potter, "A New Horn Antenna With Suprressed Sidelobes and Equal Beamwidths," Microwave J., vol. VI, pp. 71–78,Jun. 1963.

*Primary Examiner*—Don Wong
*Assistant Examiner*—James Clinger
*Attorney, Agent, or Firm*—Michael S. Yatsko

[57] ABSTRACT

A multi-mode, multi-step feed horn (10) for a satellite antenna array that includes multiple transition steps (28–34) that provide control of the mode content of the signal, and the generation of substantially equal E-plane and H-plane beamwidths, with low cross-polarization and suppressed sidelobes. In one particular embodiment, two transition steps (32, 34) allow the E-plane to expand and generate the higher order $TM_{11}$, propagation mode. The transition steps (32, 34) and a phase section (18) allow the mode content to be oriented relative to each other in the proper phase so that the useful bandwidth is on the order of 10%–15%. Two other transition steps (28, 30) provide impedance matching between a throat section (12) and the mode content transition steps (32, 34) to prevent or minimize reflections.

18 Claims, 1 Drawing Sheet

MULTIMODE, MULTI-STEP ANTENNA FEED HORN

BACKGROUND OF THE INVENTION

1. Field of the Invention

This invention relates generally to an antenna feed horn and, more particularly, to a compact, low weight antenna feed horn for a satellite communications antenna feed array or phased array, that includes multiple transition steps to provide multimode signal propagation, a relatively wide bandwidth having a low axial ratio, substantially equal E-plane and H-plane beamwidths, low cross-polarization and suppressed sidelobes.

2. Discussion of the Related Art

Various communications networks, such as Ka-band satellite communications networks, employ satellites orbiting the Earth in a geosynchronous orbit. A satellite uplink communications signal is transmitted to the satellite from one or more ground stations, and then is switched and re-transmitted by the satellite to the Earth as a downlink communications signal to cover a desirable reception area. The uplink and downlink signals are transmitted at a particular frequency bandwidth and are coded. Both commercial and military Ka-band communications satellite networks require a high effective radiating isotropic power (ERIP) in the downlink signal, and an acceptable gain versus temperature ratio (G/T) in the uplink signal for the communications link. The ERIP and G/T require a high gain antenna system, providing a smaller beam size, thus reducing the beam coverage and requiring a multi-beam antenna system. The satellite is therefore equipped with an antenna system that includes a plurality of antenna feed horns arranged in predetermined configuration that receive the uplink signals and transmit the downlink signals to the Earth over a predetermined field-of-view.

The antenna system must provide a beam scan capability up to fifteen beamwidths away from the antenna boresight with a low scan loss and minimal beam distortion in order to compensate for the longer path length losses at the edges of the field-of-view. Multi-beam antenna systems that produce a system of contiguous beams by a reflector system with the plurality of feed horns require highly circular beam symmetry, steep main beam roll-off, suppressed sidelobes and low cross-polarization to achieve low interference between adjacent beams. For cellular satellite communication, a circularly polarized system is necessary because they do not need polarization tracking.

To accomplish the above-stated parameters, the antenna feed horns must be capable of producing beam radiation patterns that have substantially equal E-plane and H-plane beamwidths over the operating frequency band of the signal. The level of the cross-polarization and the difference between the E-plane beamwidth and the H-plane beamwidth in the communication signal determines the axial ratio of the signal. If the cross-polarization is substantially low and the E-plane and H-plane beamwidths are substantially the same, the axial ratio is about one and the signals are effectively circularly polarized. However, if the E-plane and H-plane beamwidths are significantly different, the signal is elliptically polarized and the signal strength is reduced, causing increased insertion loss and data rate loss of the downlink signal.

The usable bandwidth in the downlink signal or the uplink signal that is able to transmit information is defined by the content of the propagation modes of the signal, as determined by the phase orientation of the modes. These propagation modes include the transverse electric (TE) modes where the electric field lines are in the transverse plane of wave propagation, and the transverse magnetic (TM) modes where the magnetic field lines are in the transverse plane of wave propagation. The orientation of the electric and magnetic fields in the various TE and TM modes defines the mode content of the signal.

Typical conical horns provide only the $TE_{11}$ mode, where the E-plane beamwidth was substantially less than the H-plane beamwidth. Therefore, when used to transmit or receive a circularly polarized signal, the signals were not circularly polarized, but were elliptically polarized. In order to reduce the axial ratio and provide a more circularly polarized beam, Potter horns and corrugated horns were developed in the art that generated substantially equal E-plane and H-plane patterns with suppressed sidelobes. The Potter horn is disclosed in Potter, P. D., "A New Horn Antenna With Suppressed Sidelobes and Equal Beamwidths," Microwave J., Vol. Xl, June 1963, pp. 71–78. The Potter horn is a conical shaped feed horn that includes a single step transition that provides for the propagation of the $TM_{11}$ mode for equal E-plane and H-plane beamwidths and suppressed sidelobes. The corrugated horn is a conical shaped feed horn that includes a corrugated structure within the horn from the waveguide to the aperture that also provides equal E and H plane beamwidth and suppresses the sidelobes.

Although the configuration of the Potter Horn is generally successful for providing a desirable mode content with low cross-polarization and suppressed sidelobe levels, the Potter Horn generates signals that are limited by their useful bandwidth, on the order of 3%. The corrugated horn is able to provide wider bandwidth, however, it will be heavy and more costly to fabricate due the corrugated structure of the horn.

What is needed is a compact, light weight antenna feed horn that provides substantially equal E plane and H-plane beamwidths, low cross-polarization and suppressed sidelobes, but has a higher useful bandwidth than those feed horns known in the art. It is therefore an object of the present invention to provide such an antenna feed horn.

SUMMARY OF THE INVENTION

In accordance with the teachings of the present invention, a multimode, multi-step antenna feed horn for a satellite antenna array is disclosed that includes multiple transition steps that provide effective control of the mode content of the satellite communication signal to generate substantially equal E-plane and H-plane beamwidths, with low cross-polarization and suppressed sidelobes. In one particular embodiment, two transition steps allow the E-plane to expand and generate the higher order $TM_{11}$ propagation mode so that the E-plane bandwidth and the H-plane bandwidth are about the same. The transition steps and a phase section control provide the proper power ratio and phase difference between the useful $TE_{11}$ mode and $TM_{11}$ mode over 10% or greater bandwidth. Two other transition steps provide impedance matching between a throat section and the mode content transition steps to prevent or minimize reflections.

Additional objects, advantages, and features of the present invention will become apparent from the following description and appended claims, taken in conjunction with the accompanying drawings.

DETAILED DESCRIPTION OF THE PREFERRED EMBODIMENTS

The following discussion of the preferred embodiments directed to a multi-step, multi-mode antenna feed horn for a satellite communications system is merely exemplary in nature, and is in no way intended to limit the invention or its applications or uses.

For an antenna having a required sidelobe levels of 25 dB down from the beam peak, the main reflector illumination edge taper should be approximately 12.4 dB, which provides reflector aperture efficiency of ~80%. Without a feed size constraint, and for a feed subtended angle of 22°, the required feed size for a simple conical horn is ~5.53 λ, and 6.20 λ for a dual mode horn (from experimental data). However, the required beam spacing is 1.4°, for the above described reflector system, and the allowed inner feed diameter is 3.6", which is approximately 6λ at 19.7 GHz frequency. For a cellular satellite application, a circularly polarized beam with a stringent AR specification is required. Due to an unequal far field E-plane and H-plane patterns of the conical horn and due to it's higher sidelobe level of the E-plane cut, the conical horns known in the art is not suitable for this application. A corrugated horn will provide equal E-plane and H-plane beamwidth with suppressed sidelobe over a wide bandwidth. However, due to its corrugation, it will be heavy and expensive.

A multi-mode, multi-step horn, discussed below, was designed and fabricated for the operating frequency of 19.7 to 20.2 GHz, according to the invention. For this case, since the frequency band is narrow, the multi-step design is to reduce the return loss. A second step and third step (from the horn input) will generate higher order modes to allow the $TM_{11}$ mode to propagate. Two steps for mode generation will give the designer more flexibility to optimize the mode content. There is also a phase section between the third step transition and the start of the flair angel. The phase section is served as phase match section between the $TE_{11}$ mode and the $TM_{11}$ mode. The optimum power content for a dual mode horn is $TE_{11}$ ~84% and $TM_{11}$ ~16%. The optimum phase difference between these two mode is 180°. However, this conditions only can be optimized at single frequency point. The acceptable multi-mode horn must maintain a $TM_{11}$ to $TE_{11}$ power ratio of 10% to 20%, and the phase difference between the modes should not deviate more than 45° from 180°. In order to achieve the above described criteria, especially for a large frequency bandwidth design, the horn flair angle must be less than 6.5°. For a large aperture horn, such as the 6λ horn, the required horn length is relatively long. To shorten the horn length for practical purposes and maintain the low flair angle of the horn, the phase section of the waveguide diameter is increased to allow a higher order mode ($TE_{12}$) to propagate. This also helped to reduce the cross-polarization level and further suppress the sidelobes.

Figure 1:
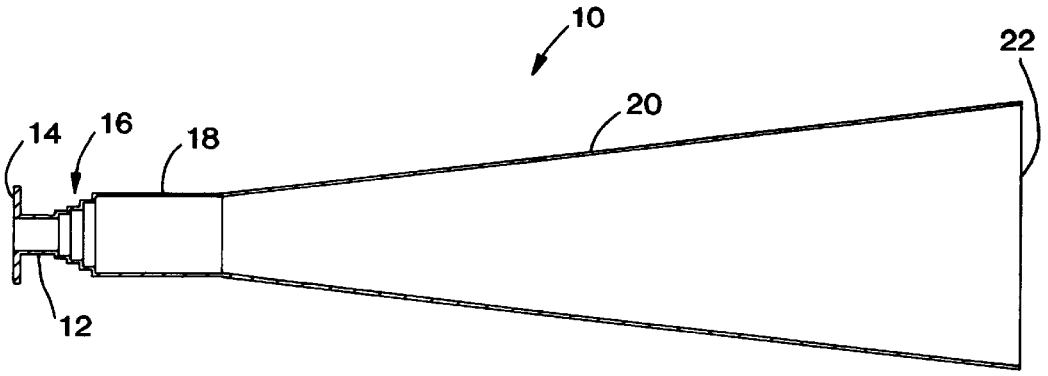
FIG. 1 is a side plan view of a multi-step, multi-mode antenna feed horn, according to an embodiment of the present invention.

FIG. 1 is a side plan view of a multi-step, multi-mode antenna feed horn 10, according to the invention, that would be one of a plurality of antenna feed horns associated with an antenna array in connection with a satellite communications network that is operating, for example, in the Ka frequency band. The antenna system can take on any suitable configuration and optical geometry for this type of communications network, such as a side-fed antenna system, a front-fed antenna system, a cassegrain antenna system, and a Gregorian antenna system. However, as will be appreciated by those skilled in the art, the design of the feed horn 10 is not limited to a particular communications network or antenna system, but has a wider application for many types of communications systems and networks. Additionally, the discussion of the feed horn 10 below will be directed to using the feed horn 10 for generating a downlink signal of the satellite communications network. However, the feed horn 10 also has reception capabilities for receiving a signal transmitted from the Earth to the satellite on a satellite uplink. Also, the feed horn 10 will transmit a signal having a frequency consistent with the communications network, such as the Ka frequency bandwidth, but can be used for any applicable frequency bandwidth, both commercial and military, including the Ka-band.

The feed horn 10 includes a cylindrical shaped throat section 12 that is connected to a waveguide (not shown) by a posterior mounting flange 14, where the waveguide directs the beam to be sent to the Earth from a beam generating device (not shown) to the feed horn 10. The throat section 12 includes a multiple step transition section 16, that includes a plurality of annular shaped expanding steps that widen the opening of the feed horn 10 from the throat section 12, as will be discussed below. The transition section 16 is connected to a cylindrical shaped phase matching section 18 that has a diameter about the same as the largest step transition in the transition section 16. The phase section 18 is connected to a conical shaped aperture section 20 that expands to define a predetermined aperture size at a mouth 22 of the horn 10. The horn 10 is made of conventional feed horn materials, such as aluminum composites, to make it lightweight and uniform in structure. The wall thicknesses of the horn 10 are suitable to withstand the space environment, and to be low cost and lightweight. The cross-sectional dimensions and diameters of the various sections of the horn 10 would be designed for the particular antenna array, signal frequency, and coverage area desired for a particular communications network, in accordance with the discussion below.

Figure 2:
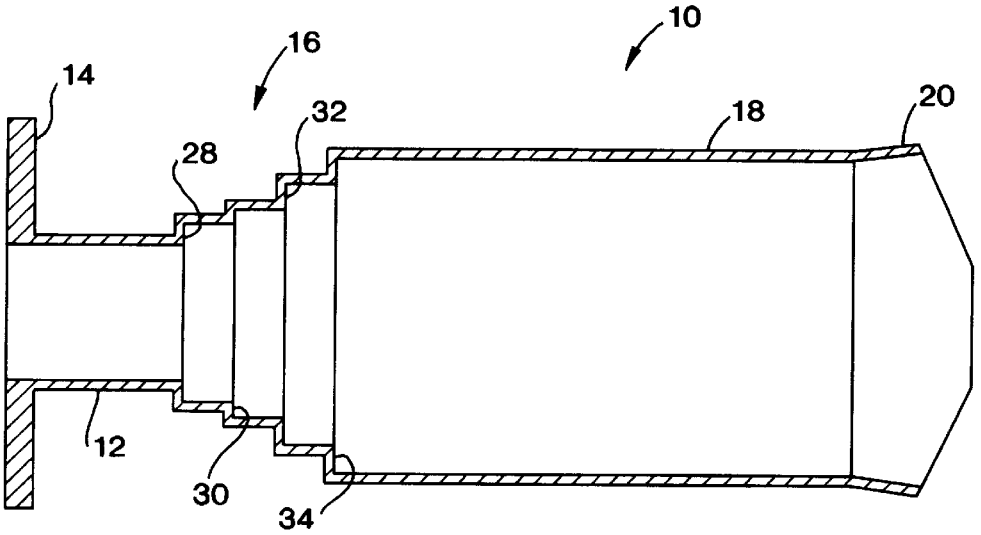
FIG. 2 is an enlarged, side view of the multi-step portion of the feed horn shown in FIG. 1.

FIG. 2 is a n enlarged side view of the transition section 16, that identifies four annular transition steps 28, 30, 32 and 34. The step configuration between the transition steps 28–34 provides sharp discontinuities (90° steps) within the horn 10. The first transition step 28 is connected to the throat section 12, and has a slightly wider diameter as the section 12, and the last transition step 34 is connected to the phase section 18 and is of the same diameter as the phase section 18. As is apparent, the transition steps 28–34 increase the horn diameter in a symmetric fashion from the throat section 12 to the phase section 18 to provide a widening of the diameter of the horn 10 in a step configuration in this area.

The diameter of the throat section 12 relative to the wavelength λ of the signal being transmitted only allows propagation of the lower order $TE_{11}$ mode. Propagation of the $TE_{11}$ mode prevents broadening of the E-plane beamwidth, and thus does not allow propagation of substantial equal E-plane and H-plane beamwidths. This creates a large axial ratio causing the signal to be elliptically polarized, as discussed above, reducing signal strength and increasing data rate loss. In order to allow the E-plane beamwidth to expand and provide the transmission of higher propagation modes, such as the $TM_{11}$ mode, a discontinuity must be provided within the horn 10 that expands the propagation diameter of the horn 10. The transition steps 28–34 provide this discontinuity. A discussion of the transmission of the TE and TM modes in a feed horn of this type can be found in the Potter article referenced above. The actual increase in diameter of the horn 10 at a discontinuity to provide propagation of the $TM_{11}$ mode can be calculated based on the frequency or wavelength λ of the signal, and is typically D>1.22λ, where D is the diameter of the horn 10.

The larger transition steps 32 and 34 provide the discontinuity and the diameter required to satisfy propagation of the $TM_{11}$ mode for the Ka frequency band. The smaller transition steps 28 and 30 provide impedance matching for the larger transition steps 32 and 34 so that the discontinuities do not provide significant reflections back towards the throat section 12 that would increase signal loss. The known conical feed horns typically required a tuning ring in the frequency matching section of the antenna system to reduce the effects of reflections. The combination of the two transition steps 32 and 34 allows the designer of the horn 10 to optimize the transition into the higher order $TM_{11}$ mode, and provide the necessary phase and amplitude relationships between the $TE_{11}$ and $TM_{11}$ modes for increased bandwidth. In other words, it is desirable to have the $TE_{11}$ and $TM_{11}$ modes be about 180° out of phase with each other at the mouth 22 to provide the desirable signal transmission of the frequency band of interest. Because the dimensions of the horn 10 are fixed, the horn 10 can only be exactly optimized for one frequency.

The multiple transition steps 32 and 34 give the flexibility to provide phase and amplitude matching for the $TE_{11}$ and $TM_{11}$ modes over a wider bandwidth. The phase section 18 is provided to further increase this optimization parameter or phase matching between the modes $TE_{11}$ and $TM_{11}$ at the aperture mouth 22. The combination of the transition steps 32 and 34 provide the discontinuity necessary for the expansion of the E field to generate the higher order $TM_{11}$ mode, and the flexibility to design the dimensions to provide an increased optimal bandwidth. By providing multiple transition steps beyond the design of the Potter Horn, the feed horn 10 of this invention provides more control for the mode content of the signal. Additional transition steps can also be provided to further increase the phase orientation of the $TE_{11}$ and $TM_{11}$ modes at the mouth 20, and provide increased control of the mode content. The resulting orientation of the $TE_{11}$ and $TM_{11}$ mode content in both phase and amplitude at the mouth 22 of the horn 10 provides a useful bandwidth on the order of 10%–15%. This control of the mode content provides for minimizing the length of the feed horn 10 for a desired aperture size at the desired operational bandwidth, and provide suppressed sidelobes and low cross-polarization of the signal.

The dimensions of the feed horn 10 may vary from application to application, and the specific configurations of the transition steps 28–34 will depend on the frequency band being transmitted. In one embodiment, for the Ka frequency band, the dimensions of the horn 10 may be as follows. The overall length of the horn 10 is about 14.314 inches; the diameter of the mouth 22 is about 3.6 inches or about 6λ of the operating frequency; the diameter of the transition step 34 and the phase section 18 is about 1.06 inches; the diameter of the transition step 32 is about 0.88 inches; the diameter of the transition step 30 is about 0.7 inches; the diameter of the transition step 28 is about 0.6 inches; the diameter of the throat section 12 is about 0.455 inches; the distance between the flange 14 and the aperture section 20 is about 2.992 inches; the distance between the flange 14 and the transition step 34 is about 1.172 inches; the distance between the flange 14 and the transition step 32 is about 0.991 inches; the distance between the flange 14 and the transition step 30 is about 0.811 inches; and the distance between the flange 14 and the transition step 28 is about 0.630 inches.

The foregoing discussion discloses and describes merely exemplary embodiments of the present invention. One skilled in the art will readily recognize from such discussion, and from the accompanying drawings and claims, that various, changes, modifications and variations can be made therein without departing from the spirit and scope of the invention as defined in the following claims.

What is claimed is:

1. A feed horn for transmitting a signal having both E-plane and H-plane beamwidths, said horn comprising:

an input section configured to receive the signal;

an output section configured to shape the signal in a predetermined manner; and a throat section positioned between the input section and the output section so that the signal travels therethrough, said throat section including a plurality of step transitions that are configured so that a minimum throat area is positioned adjacent to the input section and a maximum throat area is positioned adjacent to the output section, said plurality of transitions having dimensions relative to each other to allow propagation in three or more propagation modes and in substantially equal E-plane and H-plane beamwidths with suppressed sidelobes for all the modes.

2. The feed horn according to claim 1 wherein the throat section is cylindrical shaped and the step transitions are annular in shape.

3. The feed horn according to claim 1 wherein the throat section includes four step transitions.

4. The feed horn according to claim 3 wherein the four transitions expand in wider steps from the input section to the output section, and wherein the two largest step transitions are designed to alter the mode content of the signal and the two smallest step transitions provide impedance matching between the input section and the two larger step transitions.

5. The feed horn according to claim 1 wherein a plurality of the plurality of step transitions create propagation in multiple propagation modes and the remaining step transitions provide impedance matching between the plurality of the plurality of step transitions and the input section.

6. The feed horn according to claim 1 further comprising a cylindrical phase section positioned between the throat section and the output section.

7. The feed horn according to claim 1 wherein the output section is conical shaped.

8. The feed horn according to claim 1 wherein the feed horn is part of an antenna system including a feed array on a satellite, said signal being a satellite downlink signal, said feed array including a plurality of identical feed horns.

9. The feed horn according to claim 8 wherein the feed array is selected from the group consisting of front-fed feed arrays, side-fed feed arrays, Gregorian feed arrays, and cassegrain feed arrays.

10. A feed horn for transmitting a satellite downlink signal having both E-plane and H-plane beamwidths, said horn comprising:

a cylindrical shaped throat section configured to receive the signal;

a conical shaped aperture section configured to shape the signal at an aperture of the feed horn; and a multiple transition step section positioned between the throat section and the aperture section and being connected to the throat section, said multiple transition section including a plurality of annular shaped transition steps that expand the opening of the feed horn from the throat section towards the aperture section in a step configuration, wherein the plurality of annular shaped transition steps are dimensioned relative to each other to adjust the mode content of the signal and provide three or more propagation modes and provide substantially equal E-plane and H-plane beamwidths with suppressed sidelobes for all the modes.

11. The feed horn according to claim 10 further comprising a cylindrical phase section positioned between the multiple step transition section and the aperture section, said phase section providing a desirable phase relationship between propagation modes in the signal.

12. The feed horn according to claim 10 wherein the multiple transition step section includes four transition steps, where two of the transition steps are designed to adjust the mode content of the signal and two of the transition steps are designed to provide impedance matching between the throat section and the other two transition steps.

13. The feed horn according to claim 10 wherein the feed horn is part of an antenna system including a feed array on a satellite, said feed array including a plurality of identical feed horns.

14. The feed horn according to claim 13 wherein the feed array is selected from the group consisting of front-fed feed arrays, side-fed feed arrays, Gregorian feed arrays, and cassegrain feed arrays.

15. A method of forming a feed horn, said method comprising the steps of:

providing a throat section;

providing an aperture section opposite to the throat section; and providing a multiple step transition section connected to the throat section so that the transition step section includes a plurality of annular step transitions that widen the feed horn from the throat section towards the aperture section, said multiple step transitions being dimensioned relative to each other to alter the mode content of the signal and provide propagation of three or more propagation modes and vide substantially equal E-plane and H-plane beamwidths with suppressed sidelobes for all the modes.

16. The method according to claim 15 wherein the step of providing a multiple step transition section includes providing four step transitions.

17. The method according to claim 15 wherein the step of providing an aperture section includes providing step transitions having substantially the same step distance, wherein some of the step transitions provide impedance matching between other of the step transitions and the throat section.

18. The method according to claim 15 further comprising the step of providing a cylindrical phase section connected to the step transition section and the aperture section, said phase section providing a desirable phase relationship between propagation modes.

* * * * *